US005860174A

United States Patent [19]

Failor

[11] Patent Number: 5,860,174

[45] Date of Patent: Jan. 19, 1999

[54] PATIENT TRANSFER MATTRESS SYSTEM

[75] Inventor: Raymond A. Failor, Seville, Ohio

[73] Assignee: Hausted, Inc., Medina, Ohio

[21] Appl. No.: 760,149

[22] Filed: Dec. 3, 1996

[51] Int. Cl.[6] ..... A61G 7/10

[52] U.S. Cl. ..... 5/81.1 HS; 5/703; 5/723; 5/737; 5/922; 5/926

[58] Field of Search ..... 5/81.1 RP, 81.1 T, 5/690, 691, 703, 705, 722, 723, 737, 738, 922, 925, 926, 411, 655.9, 736, 740, 81.1 HS

[56] References Cited

U.S. PATENT DOCUMENTS

| | | | |
|---|---|---|---|
| 684,276 | 10/1901 | Lonergan | 5/703 |
| 897,979 | 9/1908 | Holding | 5/703 |
| 1,731,530 | 10/1929 | Goldeen et al. | 5/703 |
| 3,116,494 | 1/1964 | Bennett et al. | 5/411 |
| 3,829,914 | 8/1974 | Treat . | |
| 3,837,020 | 9/1974 | Bosch | 5/411 |
| 4,073,016 | 2/1978 | Koll | 5/81.1 C |
| 4,316,298 | 2/1982 | Russo et al. | 5/703 |
| 4,606,290 | 8/1986 | Marzotto | 5/499 |
| 4,796,313 | 1/1989 | DiMatteo et al. . | |
| 4,819,283 | 4/1989 | DiMatteo et al. . | |
| 4,970,738 | 11/1990 | Cole . | |
| 5,150,487 | 9/1992 | Hemphill | 5/925 |
| 5,329,655 | 7/1994 | Garner . | |
| 5,428,852 | 7/1995 | Tenuta et al. | 5/690 |

FOREIGN PATENT DOCUMENTS

WO 94/20002 9/1994 WIPO .

OTHER PUBLICATIONS

WY East Medical brochure entitled, "Give Your Patients a Lift. . . With Total Control. TotaLift–II", undated.

Medikin/Healthcare Consultants, Inc. Independent Study, entitled, "Safety in Motion Remarkable Transport Convenience Integrated Patient Transfer", dated Apr. 1988.

*Primary Examiner*—Michael F. Trettel
*Assistant Examiner*—Robert G. Santos
*Attorney, Agent, or Firm*—Hoffmann & Baron, LLP

[57] ABSTRACT

A mattress assembly including a bottom mattress section and a top, transfer mattress section is provided. The transfer mattress section includes lateral flaps which are coupled to the sides of the bottom mattress section by hook and loop type fasteners. Pull straps are secured to the flaps for moving the transfer mattress section, and a patient thereon, with respect to the bottom mattress section once the fasteners have been disengaged. The interface of the top and bottom mattress sections is low friction to facilitate sliding the top mattress section with respect to the bottom mattress section.

26 Claims, 8 Drawing Sheets

PATIENT TRANSFER MATTRESS SYSTEM

BACKGROUND OF THE INVENTION

1. Field of the Invention.

The field of the invention relates to patient transfer assemblies for transferring patients from hospital beds, stretchers or the like to other supports.

2. Brief Description of the Prior Art.

The difficulty of moving a patient from one support, such as a stretcher, to another is well recognized. Various systems have accordingly been designed for transferring patients without actually first lifting them.

One such system is disclosed in U.S. Pat. No. 4,970,738. This system includes a semi-rigid transfer apron and a mattress attached to the transfer apron. Low friction belts are attached to the transfer apron and to an endless belt. A crank is employed to rotate the endless belts, causing the transfer apron to be translated laterally across a rigid support.

U.S. Pat. No. 4,796,313 and U.S. Pat. No. 4,819,283 disclose transfer mechanisms including transfer sheets wound upon rollers. The patient is transported longitudinally as opposed to laterally.

U.S. Pat. No. 5,329,655 discloses a method for turning or transferring a patient which includes the use of a bed sheet having a bottom surface characterized by low frictional drag and a top surface having higher frictional drag. The sheet is ordinarily tucked under a mattress to maintain it in place.

U.S. Pat. No. 3,829,914 discloses a sheet including a slippery bottom surface and handles. The sheet is used for positioning a patient upon a mattress.

WO 94/2002 discloses a sheet including gripping strips for shifting a patient from one bed to another. The sheet is positioned on a mat conveyor to effect transfer.

SUMMARY OF THE INVENTION

A patient transfer mattress assembly is provided which includes a bottom mattress section and a top mattress section. The top mattress section functions as a transfer mattress.

The bottom mattress section includes one or more first fasteners, preferably in the form of hook fasteners, capable of engagement with loop-type fasteners. The top mattress section preferably conforms to the shape of the top surface of the bottom mattress section. It includes one or more second fasteners which are releasably engageable with the first fasteners on the bottom mattress section. One or more handles are coupled to the top mattress section for allowing it to be pulled across the bottom mattress section.

The interface between the top and bottom mattress sections exhibits low frictional drag to facilitate sliding the top mattress section with respect to the bottom mattress section. Such low frictional drag is preferably accomplished by providing a low friction bottom surface on the top mattress section.

In a preferred embodiment of the invention, the transfer mattress includes a generally flat, resilient body including a low friction bottom surface. A plurality of flaps are connected to the body, and extend laterally therefrom. Fasteners are provided on each of the flaps. Handles are coupled to the body, preferably by the flaps.

The mattress assembly functions as an ordinary mattress on a stretcher or other support until transfer of a patient is to be effected. A second patient support, such as a bed or x-ray table, is then moved into adjoining relation to the stretcher or other support. The laterally extending flaps of the top mattress section are disengaged from the first fasteners on the bottom mattress section. The handles are then grasped, and the top mattress section pulled laterally with respect to the bottom mattress section onto another support. The patient may then be rolled on his side, and the top mattress section removed and recoupled to the bottom mattress section. Alternatively, the patient can remain on the top mattress section while positioned on the new support as it provides sufficient cushioning for patient comfort.

DETAILED DESCRIPTION OF THE INVENTION

Figure 1:
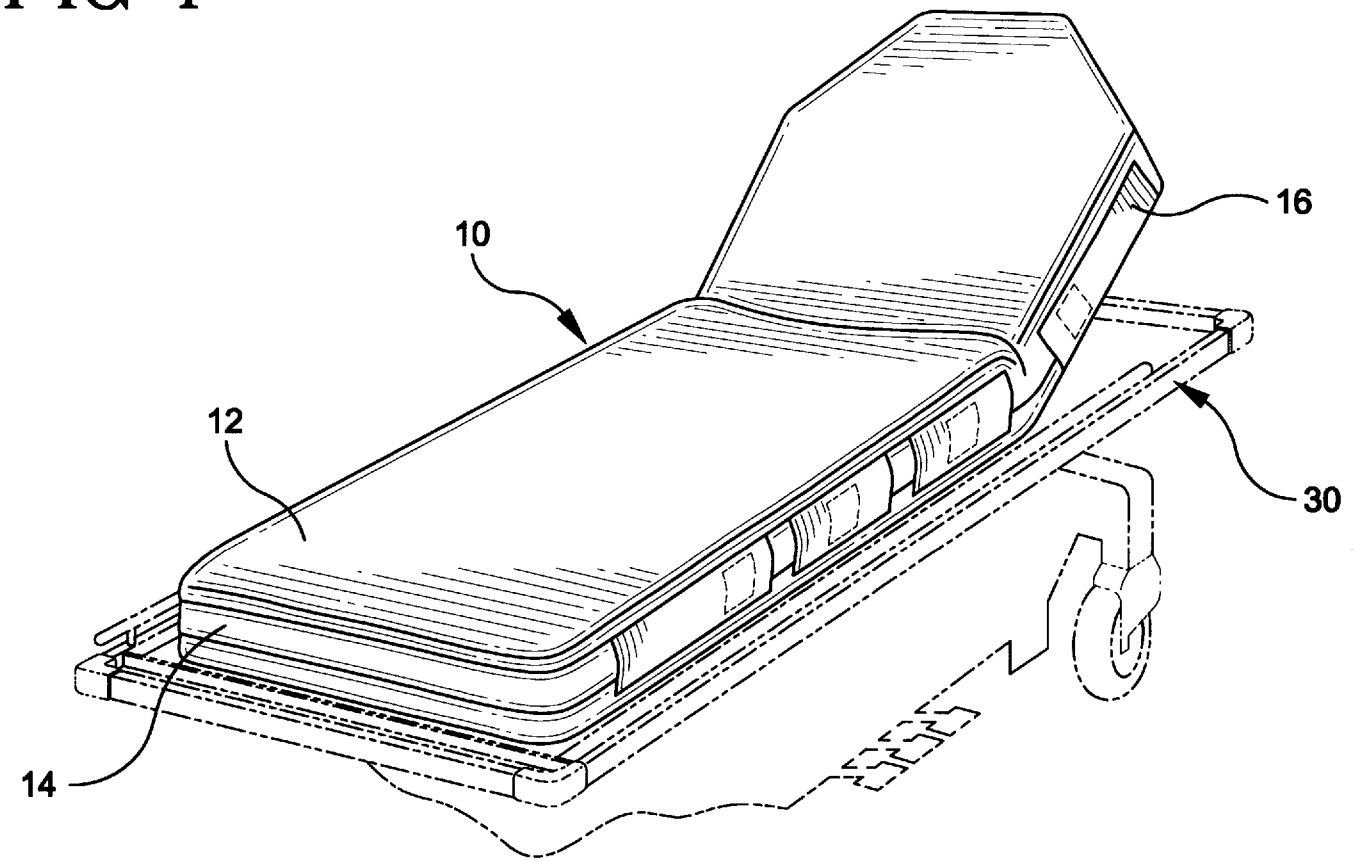
FIG. 1 is a top perspective view of a mattress assembly according to the invention.
Figure 2:
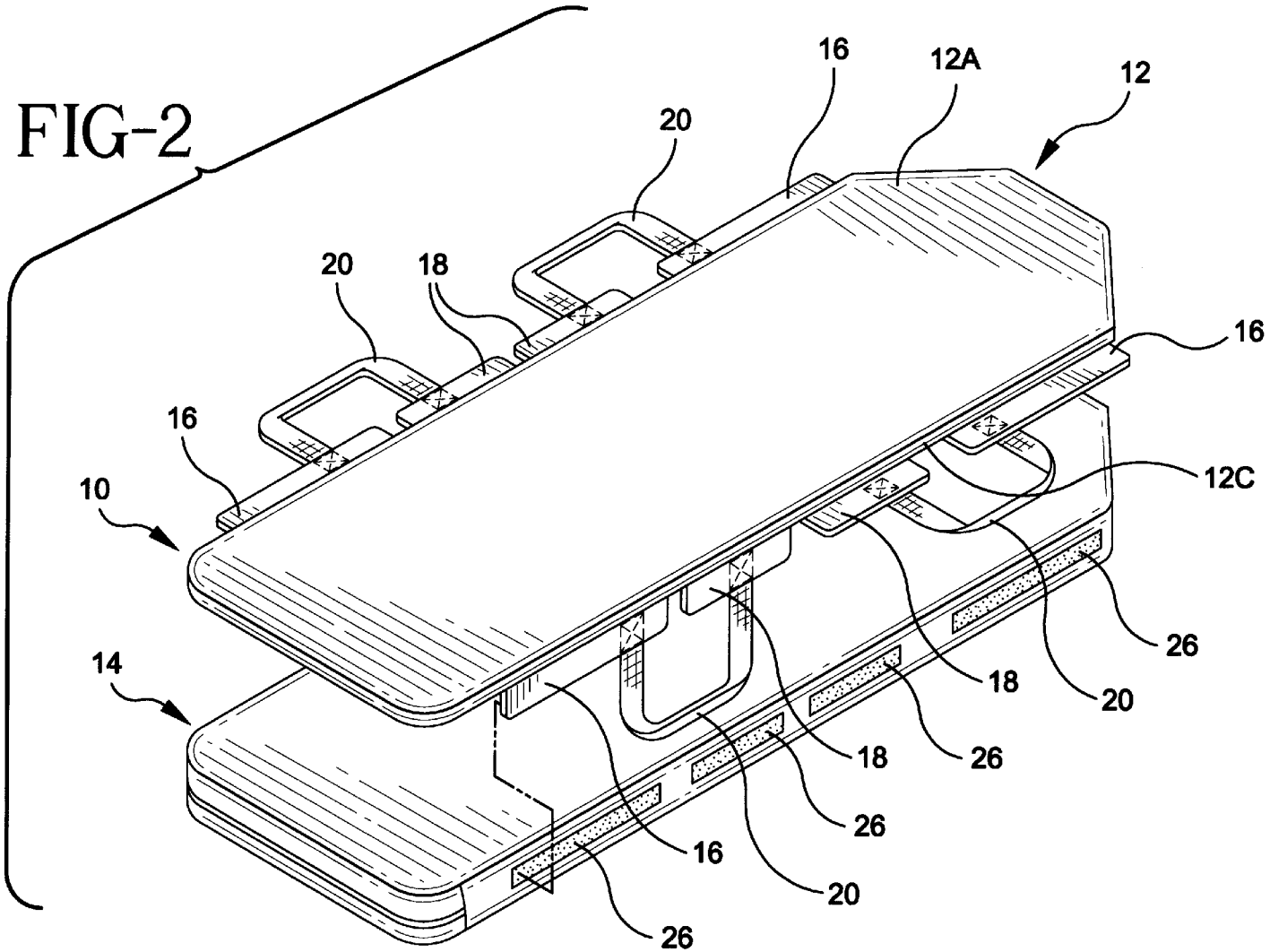
FIG. 2 is an exploded, perspective view thereof.
Figure 3:
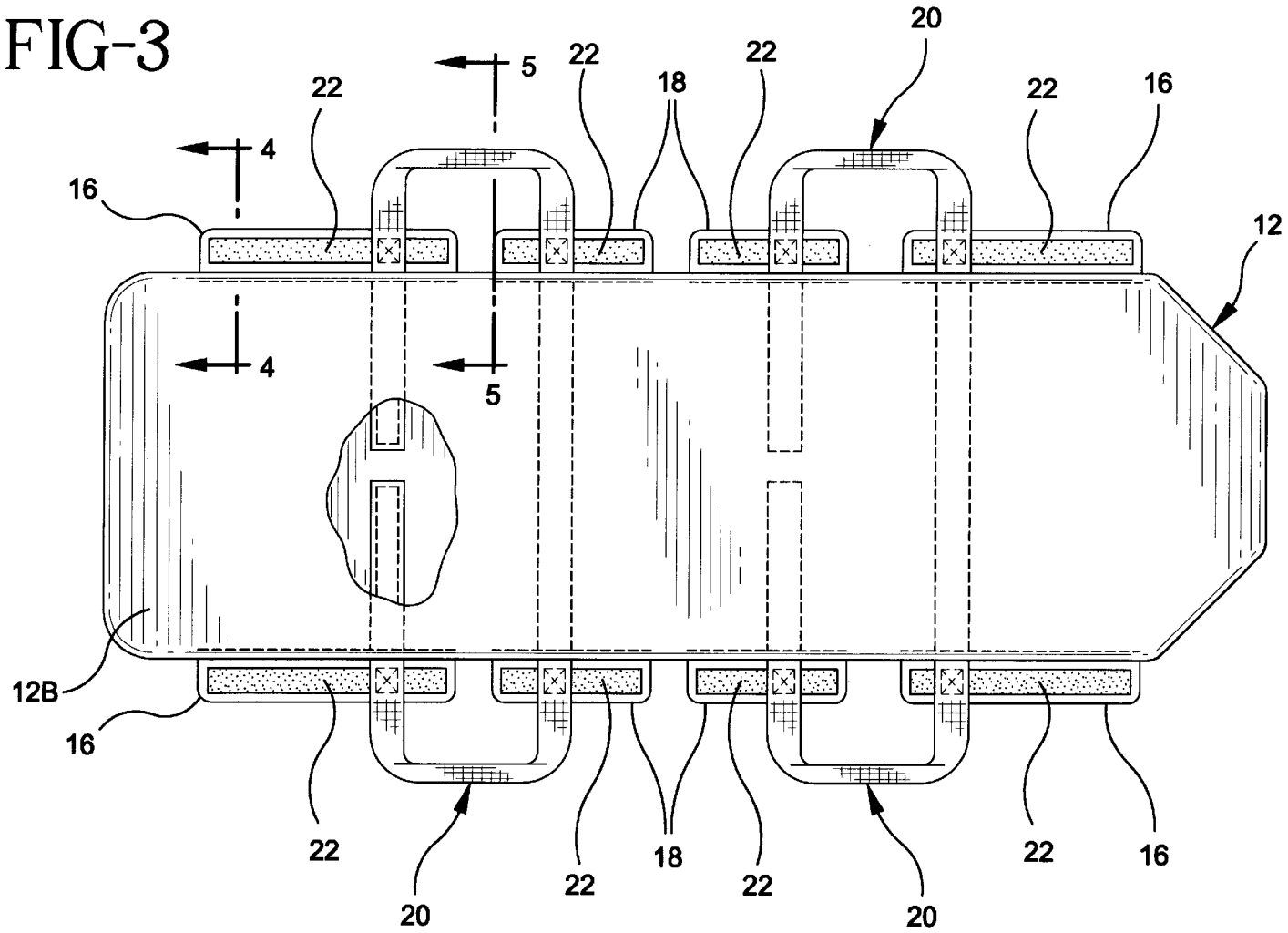
FIG. 3 is a bottom plan view of a top mattress section of the mattress assembly.
Figure 5:
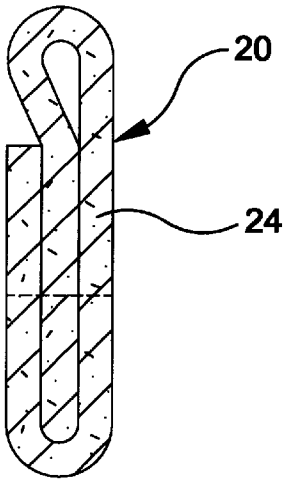
FIG. 5 is a sectional view of a handle taken along line 5—5 of FIG. 3.
Figure 4:
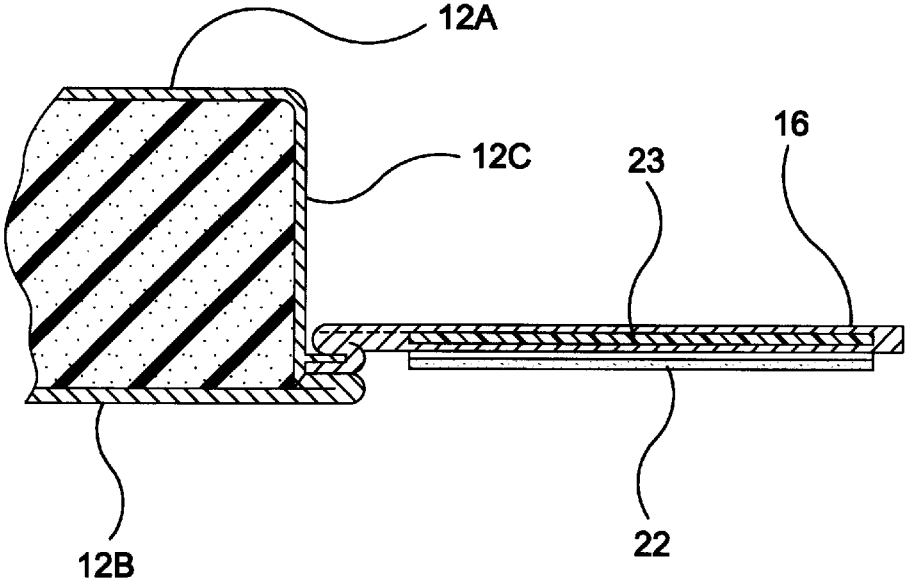
FIG. 4 is a sectional view thereof taken along line 4—4 of FIG. 3.
Figure 6:
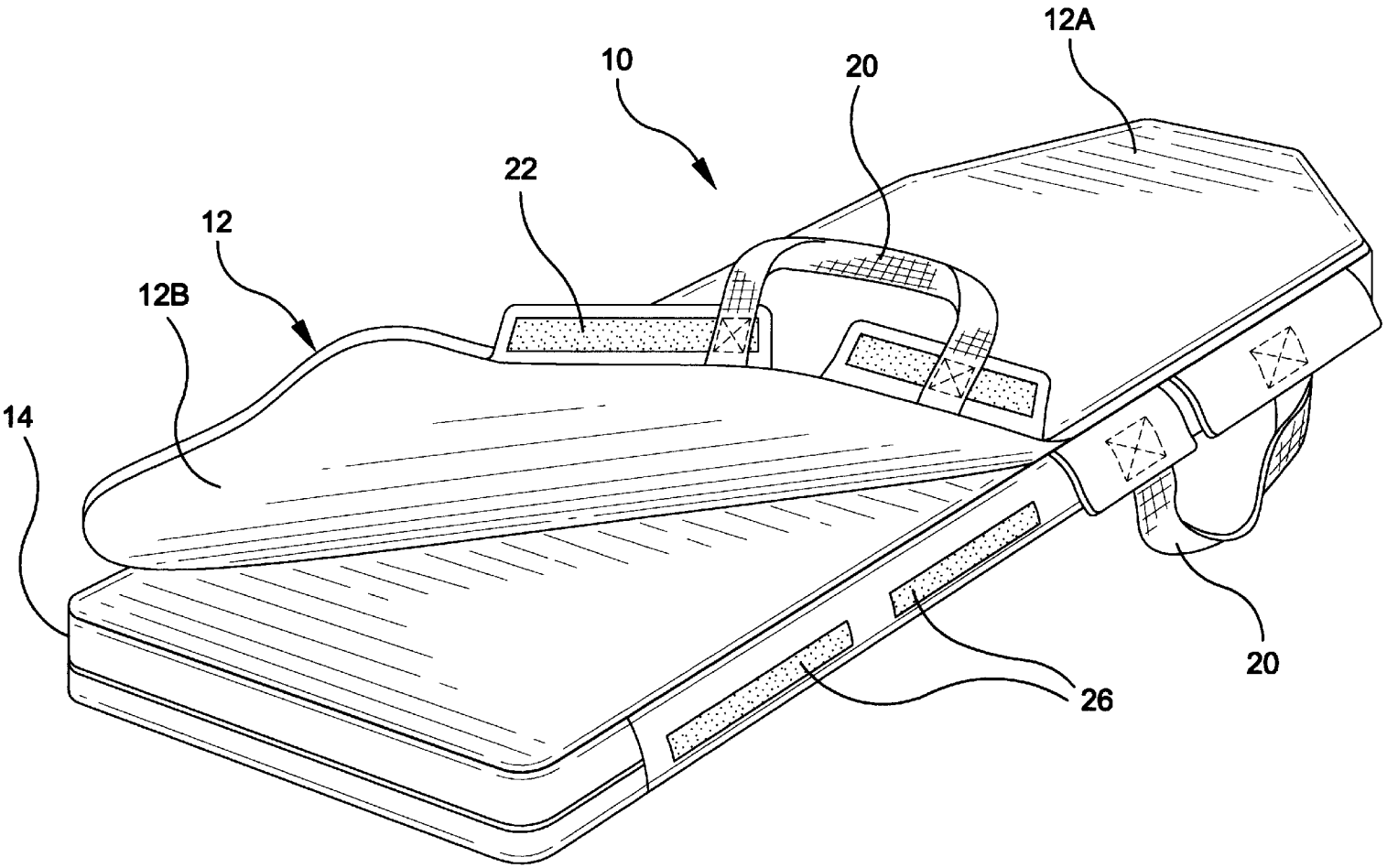
FIG. 6 is a top perspective view of the mattress assembly showing the top mattress section partially uncoupled therefrom.

A mattress assembly 10 is provided for facilitating the transfer of a patient from a first support, such as a stretcher, to a second support, such as an x-ray table. The assembly is designed so that such transfer can be accomplished in a manner which is safe for both the patient and attending staff. It is also designed for use with most stretchers or carts, regardless of manufacturer.

The mattress assembly 10 includes a top mattress section 12 and a bottom mattress section 14. Both mattress sections are preferably of the type including a foam core encased by a conductive cover. The foam may be urethane having a density of 40–45 ILD for the top section and about 35 ILD for the bottom section. The top section preferably has a thickness of about one inch, while the thickness of the bottom section is two to three inches.

In order to minimize static electricity, the covers of both mattress sections are conductive. The top mattress section includes a top surface 12A, a bottom surface 12B, and a plurality of side surfaces 12C. The cover of the top mattress section is preferably comprised of STAPHCHEK LECTROLITE COMFORT fabric at the top and sides. The trademarks STAPHCHEK and LECTROLITE are owned by Heculite Protective Fabrics Corp., and describe an electrically conductive, fire resistant fabric recommended for use on mattresses and pads in operating rooms and other potentially hazardous locations. The bottom of the cover, which is designed to provide much less friction than the top, is preferably comprised of a 0.010 thick cotton/poly fabric sold under the trade name CHEMLAM ® 700. CHEMLAM 700 is a trademark of Chemfab Corporation, and refers to a multi-layer static dissipative fluoropolymer film with a filly sintered PTFE (TEFLON) surface for low friction, chemical and flame resistance, and barrier properties, laminated to a flexible cotton/polyester fabric substrate.

The cover of the bottom mattress section may be STAPHCHEK LECTROLITE COMFORT fabric on the top and sides, while the bottom is LECTROLITE DUOTONE fabric. The length and width dimensions of the top and bottom mattress sections are substantially the same. Maximum length may be about seventy-six inches, while maximum width is about 24–25 inches.

The top mattress section 12 is constructed to function as a transfer mattress. Two pairs of flaps 16, 18 extend laterally therefrom, and two pairs of handles 20 are secured to the respective pairs of flaps. Each flap 16, 18 is stitched to the cover. The side and bottom cover portions are hemmed together two times, and the flaps are secured at the hems. (There are no seams at the top of the mattress section). Each pair of flaps includes a relatively long flap 16 near an end of the top mattress section, and a relatively short flap 18 near the center thereof. The longer flaps may, for example, be about sixteen inches in length while the shorter flaps have a length of about ten inches. The width of each flap may be about 2% inches. Spaces are provided between the flaps at the points the top mattress section can be expected to articulate.

A strip of pile fabric 22, preferably about two inches in width, is sewn to each flap. The pile fabric, preferably VELCRO loop fabric, serves as a fastener for securing the top mattress section to the bottom mattress section. In order to provide rigidity, each flap preferably includes a plastic liner 23 encased within a conductive fabric cover. The flaps are accordingly semi-rigid.

The handles 20 are preferably formed from two inch wide nylon straps 24 which are folded twice and stitched at selected portions to provide hand grips. The remaining portions of each strap forms a substantially endless loop. The straps are sewn to the flaps and to the inside of the bottom cover.

The bottom mattress section 14 includes four strips of hook-type fasteners 26 secured to each side thereof, preferably by stitching. The two inner strips may be about one by eight inches, and the two outer strips about one by fourteen inches when used with a top mattress section having pile sections as described above. The flaps 16,18 will accordingly cover the hook-type fasteners 26 completely when the top mattress is secured to the bottom mattress section by engagement of the respective fasteners 22,26. The bottom side of the bottom mattress section may include a pair of VELCRO pile strips (now shown) stitched thereto. The strips extend along the center line of the bottom side, and may each be about two inches wide and twelve inches in length.

The mattress assembly 10 may be employed upon any support from which a patient may require transport, such as a stretcher 30 shown in phantom lines in FIG. 1. The support preferably includes strips of VELCRO hook fabric for engaging the corresponding pile strips of the bottom mattress section.

Figure 7:
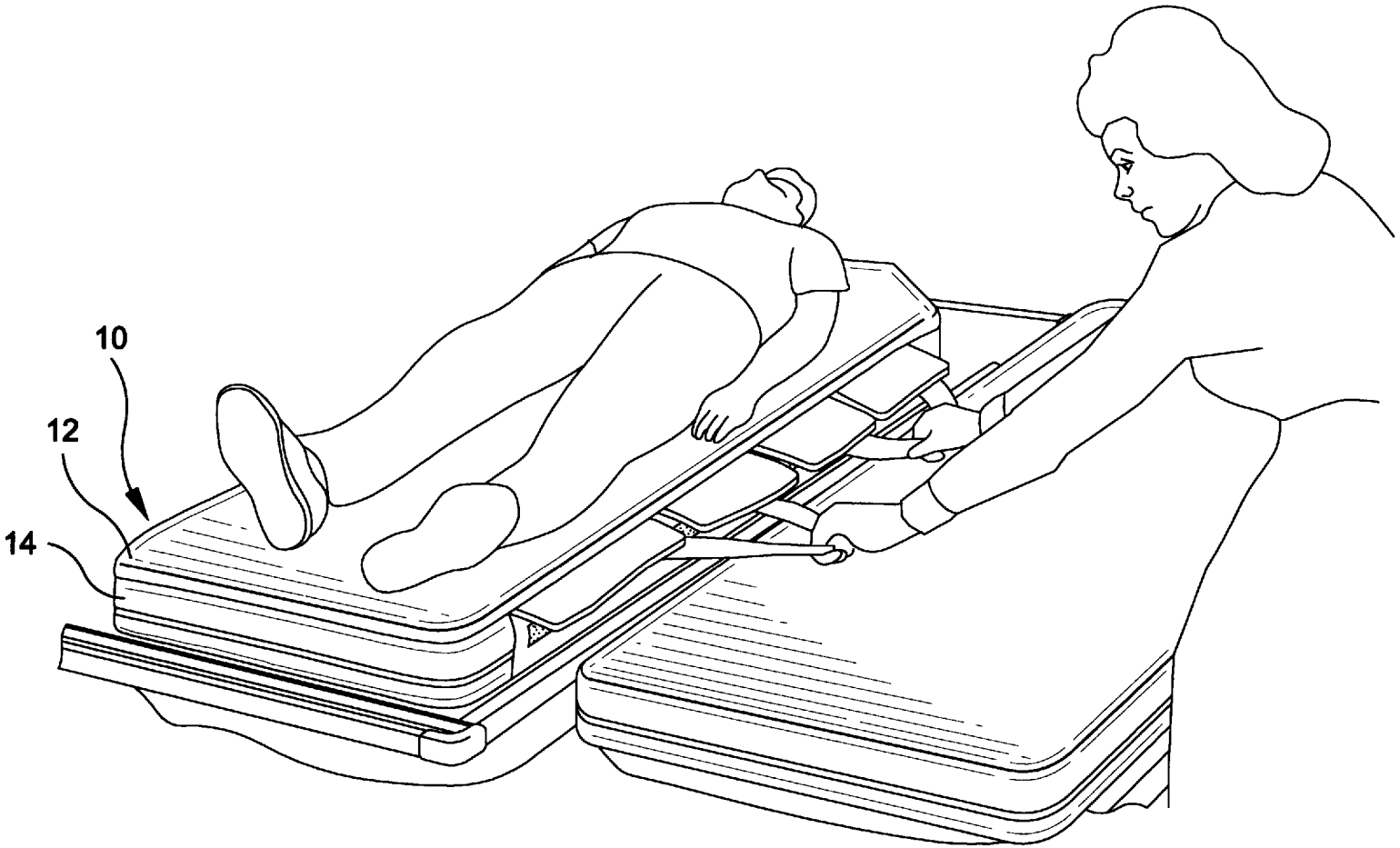
FIG. 7 is a perspective view showing the top mattress section as uncoupled from a bottom mattress section, thereby allowing the transfer of a patient to a second support.
Figure 8:
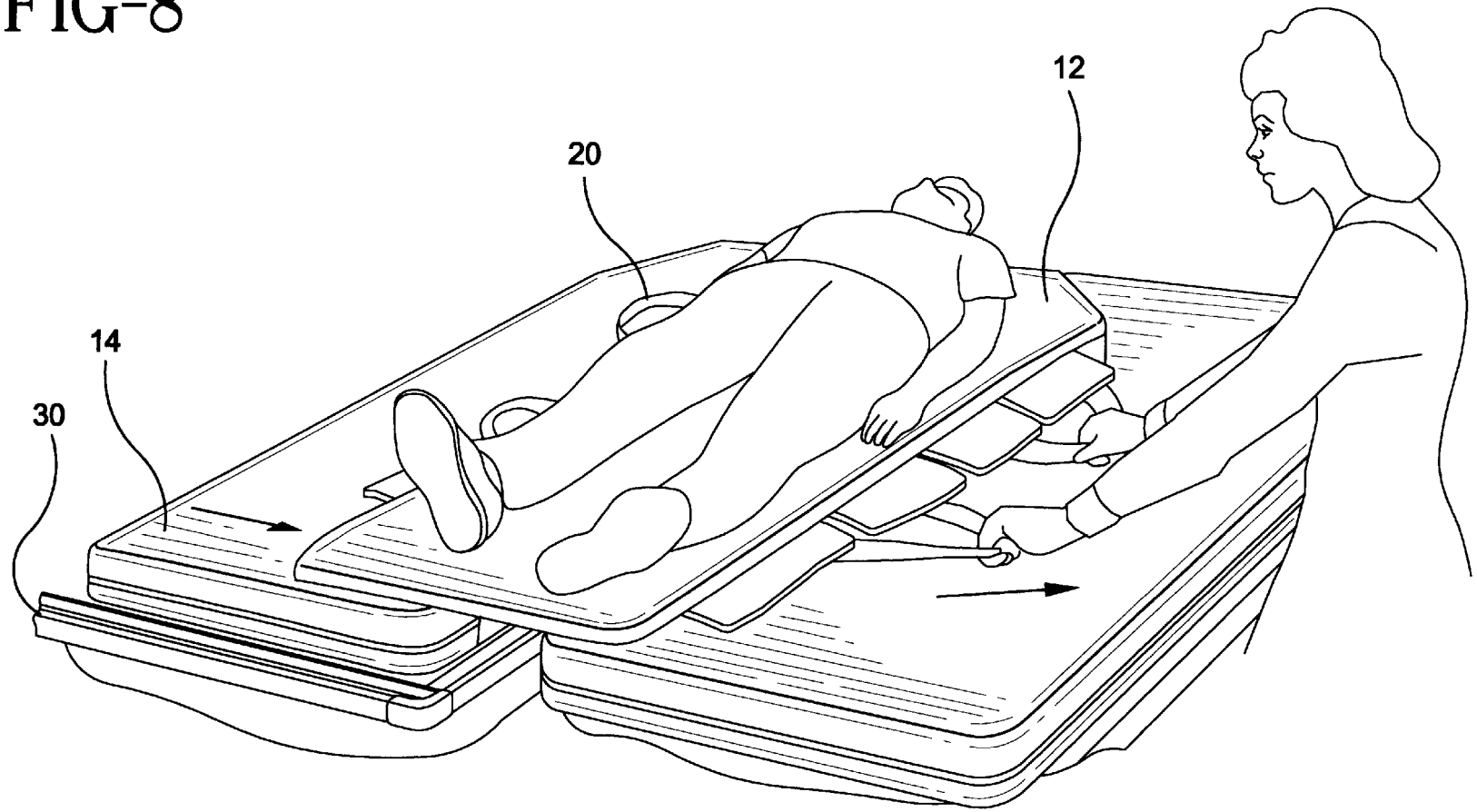
FIG. 8 is a perspective view showing the transfer of a patient from one support to another.
Figure 9:
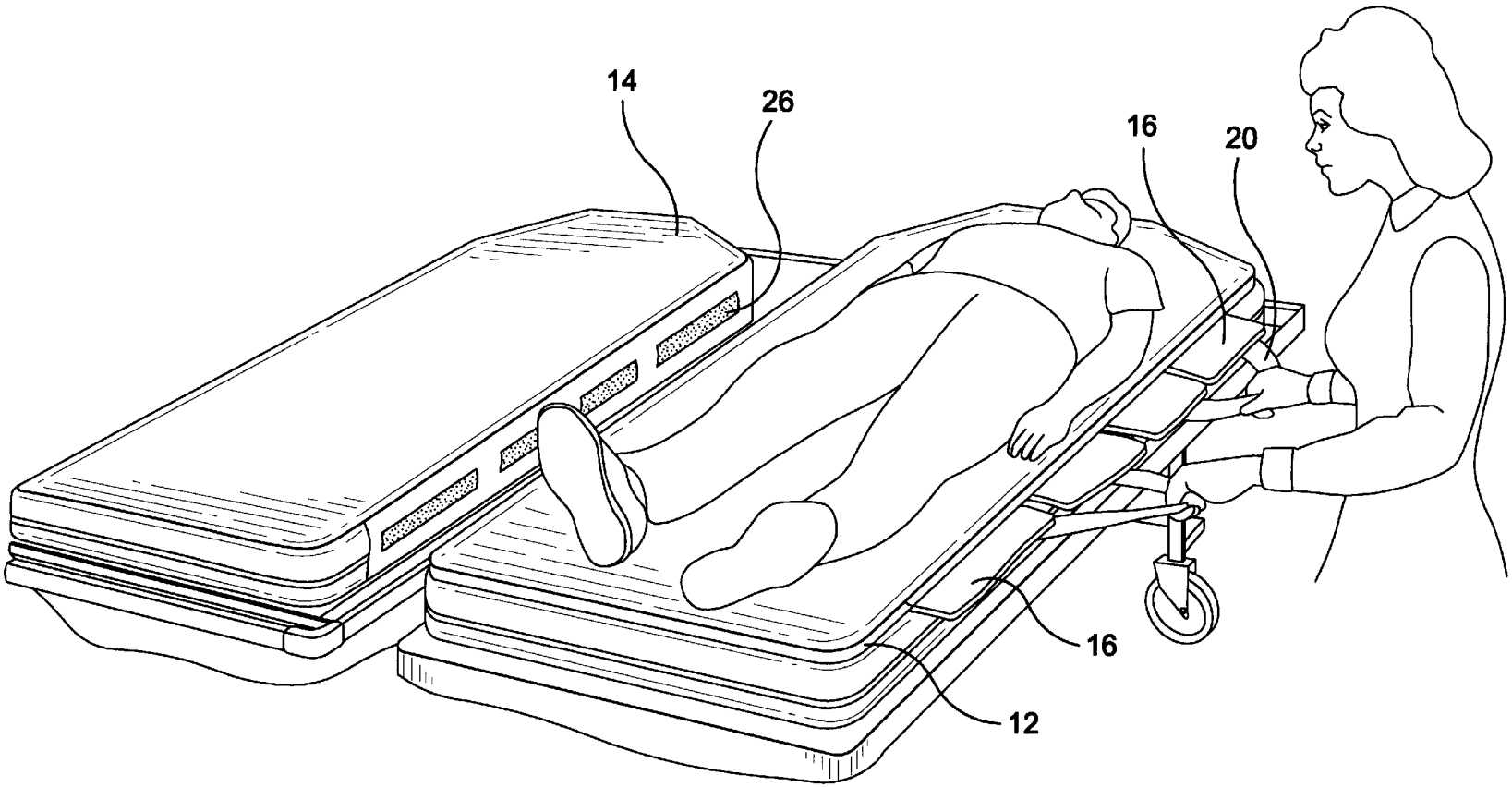
FIG. 9 is a perspective view showing the patient transferred to another support from the mattress assembly.

In order to transfer a patient, the stretcher is moved into adjoining position with the support (e.g. a bed or table) to which the patient is to be transferred. This step is shown in FIG. 7. The four side flaps 16,18 are pulled up, thereby disconnecting the fasteners 22,26. The handles 20 adjoining the support next to the stretcher are grasped. The top mattress section is then slowly pulled until the patient is in the desired position on the support, as shown in FIGS. 8 and 9.

If the patient is transferred to a support such as a hospital bed, he is rolled on his side onto the bed surface, and the top mattress section is moved back upon the bottom mattress section 14, which remains on the stretcher. If the patient is transferred to an x-ray table or the like, he may remain on the top mattress section for the duration of the procedure to be conducted thereon. As such tables ordinarily have hard surfaces, the top mattress section provides the cushioning which would otherwise be lacking. The radiolucency of the top mattress section ensures that the test procedure is not compromised. Once the procedure is completed, the patient could easily be transferred back to the stretcher by sliding the top mattress section back upon the bottom mattress section. The side flaps 16,18 would then be pressed against the sides of the bottom mattress section, causing re-engagement of the fasteners.

The mattress assembly as described above ensures patient comfort when used as a two-piece mattress. It enables patient transfer by one individual in a safe and effective manner. Patient comfort is maintained as lifting is not required. The potential for attendant back injury is also reduced in the absence of the necessity for patient lifting.

While a number of specific dimensions are described above, the mattress assembly can be made to any size, length or width. It can accordingly be made to fit any stretcher, bed, ambulance cart, reclining chair or other support.

What is claimed is:

1. A mattress assembly comprising:

a bottom mattress section including a top surface, a bottom surface, and a plurality of side surfaces extending between said top and bottom surfaces;

at least one first fastener mounted to said bottom mattress section;

a top mattress section including a resilient body, a cover encasing said resilient body and including a top surface, a bottom surface, and a plurality of side surfaces extending between said top and bottom surfaces of said cover, said bottom surface of said cover at least generally conforming to the shape of said top surface of said bottom mattress section;

at least one second fastener mounted to said top mattress section, said second fastener and said first fastener being releasably engageable to releasably secure said top mattress section to said bottom mattress section;

said bottom surface of said cover of said top mattress section exhibiting substantially less friction than said top surface of said cover to facilitate sliding said top mattress section with respect to said bottom mattress section, and a handle secured to said top mattress section.

2. A mattress assembly as described in claim 1 wherein said bottom surface of said cover is substantially entirely slippery.

3. A mattress assembly as described in claim 2 wherein said bottom surface of said cover is comprised of a multilayer static dissipative fluoropolymer film with PTFE surface.

4. A mattress assembly as described in claim 1 wherein said top mattress section includes a plurality of laterally extending flaps, each of said flaps including a second fastener, said bottom mattress section including a plurality of first fasteners engageable, respectively, with said second fasteners.

5. A mattress assembly as described in claim 4 including a handle secured to each of said flaps.

6. A mattress assembly as described in claim 5 including at least two pairs of flaps extending laterally from said top mattress section, said handles being pull straps connected, respectively, to adjacent pairs of said flaps.

7. A mattress assembly as described in claim 4 wherein said first and second fasteners are hook and loop type fasteners, respectively.

8. A mattress assembly as described in claim 1 wherein said top mattress section is comprised of a foam body and said cover is comprised of a conductive fabric.

9. A mattress assembly as described in claim 8 wherein said bottom mattress section is comprised of a foam body covered with a conductive fabric.

10. A mattress assembly as described in claim 9 including a plurality of semi-rigid flaps extending laterally from said top mattress section, said flaps each including a second fastener, said side surfaces of said bottom mattress section including a plurality of first fasteners engageable, respectively, with said second fasteners.

11. A mattress assembly as described in claim 1 wherein said top mattress section is about one inch thick and said bottom mattress section is between about two and three inches thick.

12. A mattress assembly comprising:

a resilient bottom mattress section including a top surface, a bottom surface, and a plurality of side surfaces extending between said top and bottom surfaces, a plurality of first fasteners mounted to said bottom mattress section;

a resilient top mattress section including a resilient body covered with a conductive fabric cover and having a top surface, a bottom surface, and a plurality of side surfaces extending between said top aid bottom surfaces of said top mattress section;

a plurality of flaps extending laterally from said top mattress section, each of said flaps including second fasteners engageable with said first fasteners, and a plurality of handles extending laterally from said top mattress section, each of said handles being comprised of an elongated strap including first and second portions extending within said cover and beneath said resilient body, said first and second strap portions being secured to said cover, each of said straps including a third portion forming a loop extending outside said cover.

13. A mattress assembly as described in claim 12 wherein said top mattress section includes a foam body covered with a conductive fabric, at least one of said bottom surface of said top mattress section and said top surface of said bottom mattress section being slippery to facilitate sliding said top mattress section with respect to said bottom mattress section, and said flaps are semi-rigid.

14. A mattress assembly as described in claim 13 wherein each of said handles is coupled to at least one of said flaps.

15. A mattress assembly as described in claim 13 wherein said first fasteners are mounted to said side surfaces of said bottom mattress section, and said bottom surface of said top mattress section includes a fluoropolymer film having PTFE.

16. A mattress assembly as described in claim 13 wherein said first and second fasteners are hook and loop type fasteners, respectively.

17. A mattress assembly as described in claim 12 wherein said top mattress section is about one inch thick and said bottom mattress section is between about two and three inches thick.

18. A transfer mattress for transferring a patent from a first support to a second support comprising:

a generally flat, resilient body including a top surface, a bottom surface, and a plurality of side surfaces extending between said top and bottom surfaces;

a cover encasing said generally flat, resilient body, said cover including a bottom surface and a top surface, said bottom surface of said cover exhibiting substantially less friction than said top surface of said cover to facilitate sliding said generally flat, resilient body with respect to a second body;

a plurality of flaps extending laterally from said body, each of said flaps including a fastener for fastening said body to a second body, and a plurality of handles coupled to said body.

19. A transfer mattress as described in claim 18 wherein said body includes a foam core and said cover encasing said core is conductive, said flaps being semi-rigid and pivotably secured to said cover.

20. A transfer mattress as described in claim 18 wherein said bottom surface of said cover is comprised of a multilayer static dissipative fluoropolymer film with a PTFE surface.

21. A transfer mattress as described in claim 19 wherein each of said handles is a pull strap coupled to a pair of adjacent flaps.

22. A transfer mattress as described in claim 18 wherein said body is radiotranslucent.

23. A transfer mattress as described in claim 18 wherein the thickness of said generally flat, resilient body with said cover is about one inch thick.

24. A transfer mattress as described in claim 18 wherein said handles are comprised of straps sewn to said flaps and to said cover, portions of said straps extending within said cover below said bottom surface of said generally flat, resilient body.

25. A mattress assembly comprising;

a bottom mattress section including a top surface, a bottom surface, and a plurality of side surfaces extending between said top and bottom surfaces;

a plurality of first fasteners mounted to said bottom mattress section;

a top mattress section including a top surface, a bottom surface, a plurality of side surfaces extending between said top and bottom surfaces of said top mattress section, said bottom surface of said top mattress section at least generally conforming to the shape of said top surface of said bottom mattress section, and at least two pairs of laterally extending flaps;

at least one second fastener mounted to each of said laterally extending flaps, said second fasteners and said first fasteners being releasably engageable to releasably secure said top mattress section to said bottom mattress section;

at least one of said bottom surface of said top mattress section and said top surface of said bottom mattress section being a slippery surface to facilitate sliding said top mattress section with respect to said bottom mattress section, and a plurality of handles, each handle being secured to adjacent pairs of said flaps of said top mattress section.

26. A transfer mattress for transferring a patient from a first support to a second support, comprising:

a generally flat, resilient body comprising a foam core and a conductive cover encasing said core, and further including a top surface, a bottom surface, and a plurality of side surfaces extending between said top and bottom surfaces, said bottom surface being slippery to facilitate sliding said generally flat resilient body along a surface of a second body;

a plurality of semi-rigid flaps extending laterally from said body and pivotably secured to said cover, each of said flaps including a fastener for fastening said body to a second body, and a plurality of handles coupled to said body, each of said handles being a pull strap coupled to a pair of adjacent flaps.

* * * * *